US009901122B2

(12) United States Patent
Li et al.

(10) Patent No.: US 9,901,122 B2
(45) Date of Patent: Feb. 27, 2018

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Xingbing Zou, Shenzhen (CN); Guiyuan Yu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 331 days.

(21) Appl. No.: 14/810,453

(22) Filed: Jul. 27, 2015

(65) Prior Publication Data

US 2016/0029699 A1 Feb. 4, 2016

(30) Foreign Application Priority Data

Jul. 30, 2014 (CN) ..... 2014 2 0424133 U

(51) Int. Cl.
*A24F 47/00* (2006.01)

(52) U.S. Cl.
CPC ..... *A24F 47/008* (2013.01)

(58) Field of Classification Search
CPC ... A24F 47/008; A61M 15/06; A61M 11/042; A61M 2205/3653; A61M 2205/8206; A61M 15/0036; A61M 15/004
See application file for complete search history.

(56) References Cited

U.S. PATENT DOCUMENTS

| | | | | |
|---|---|---|---|---|
| 9,622,511 | B2 * | 4/2017 | Zhu | A24F 47/008 |
| 2012/0199663 | A1 * | 8/2012 | Qiu | A61M 11/041 239/8 |
| 2014/0190477 | A1 * | 7/2014 | Qiu | A61M 11/042 128/202.21 |
| 2015/0040929 | A1 * | 2/2015 | Hon | A24F 47/008 131/329 |

(Continued)

FOREIGN PATENT DOCUMENTS

| | | | | |
|---|---|---|---|---|
| CN | 102379458 B | * | 3/2012 | |
| EP | 2979556 B1 | * | 12/2016 | A24F 47/008 |
| WO | WO 2014071747 A1 | * | 5/2014 | A24F 47/008 |

OTHER PUBLICATIONS

International Search Report for EP 2979556 dated Oct. 21, 2015.*

*Primary Examiner* — Michael J Felton
*Assistant Examiner* — Jerzi H Moreno Hernandez
(74) *Attorney, Agent, or Firm* — Cheng-Ju Chiang

(57) ABSTRACT

An exemplary atomizer includes a main body, a liquid supply, a piercing element, and an atomizing assembly. The liquid supply is configured for storing tobacco liquid. The liquid supply is received in the main body. The liquid supply includes an end wall having a fixing part, a sealing part, and a recessed part. The recessed part connects the fixing part and the sealing part. The piercing element is spatially corresponding to the recessed part. The piercing element is configured for pricking the recessed part in response to an external force, so that the tobacco liquid in the liquid supply flows out, and the atomizing assembly absorbs the tobacco liquid flowed out for vaporization.

7 Claims, 5 Drawing Sheets

(56) References Cited

U.S. PATENT DOCUMENTS

| | | | | |
|---|---|---|---|---|
| 2015/0282529 | A1* | 10/2015 | Li | A24F 47/008 131/273 |
| 2015/0282530 | A1* | 10/2015 | Johnson | A24F 47/008 392/387 |
| 2015/0342256 | A1* | 12/2015 | Chen | H05B 3/06 392/404 |
| 2015/0342258 | A1* | 12/2015 | Chen | H05B 3/06 131/329 |
| 2016/0309782 | A1* | 10/2016 | Malgat | A24F 47/004 |
| 2017/0071256 | A1* | 3/2017 | Verleur | A24F 47/008 |
| 2017/0079329 | A1* | 3/2017 | Zitzke | A24F 47/008 |

* cited by examiner

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

Nowadays, electronic cigarettes are becoming more and more popular as substitutes of traditional cigarettes. Electronic cigarettes heat tobacco liquid inside to form aerosol. The tobacco liquid keeps volatilizing during transportation and sale. Accordingly, a period of validity of the tobacco liquid may be short.

To prolong the period of validity, an electronic cigarette is proposed with a liquid supply containing tobacco liquid. In use, the liquid supply is pushed into a housing of the electronic cigarette, an end wall of the liquid supply is pierced, and then the tobacco liquid flows out to a liquid absorbing component and an atomizing assembly for vaporization. However, sometimes the end wall may be too hard to be pricked. Therefore, user experience is unsatisfactory.

What is needed, therefore, is an atomizer and an electronic cigarette using same, which can overcome the above shortcomings.

SUMMARY

An exemplary atomizer includes a main body, a liquid supply, a piercing element, and an atomizing assembly. The liquid supply is configured for storing tobacco liquid. The liquid supply is received in the main body. The liquid supply includes an end wall having a fixing part, a sealing part, and a recessed part. The recessed part connects the fixing part and the sealing part. The piercing element is spatially corresponding to the recessed part. The piercing part is configured for pricking the recessed part in response to an external force, so that the tobacco liquid in the liquid supply flows out, and the atomizing assembly absorbs the tobacco liquid flowed out for vaporization.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
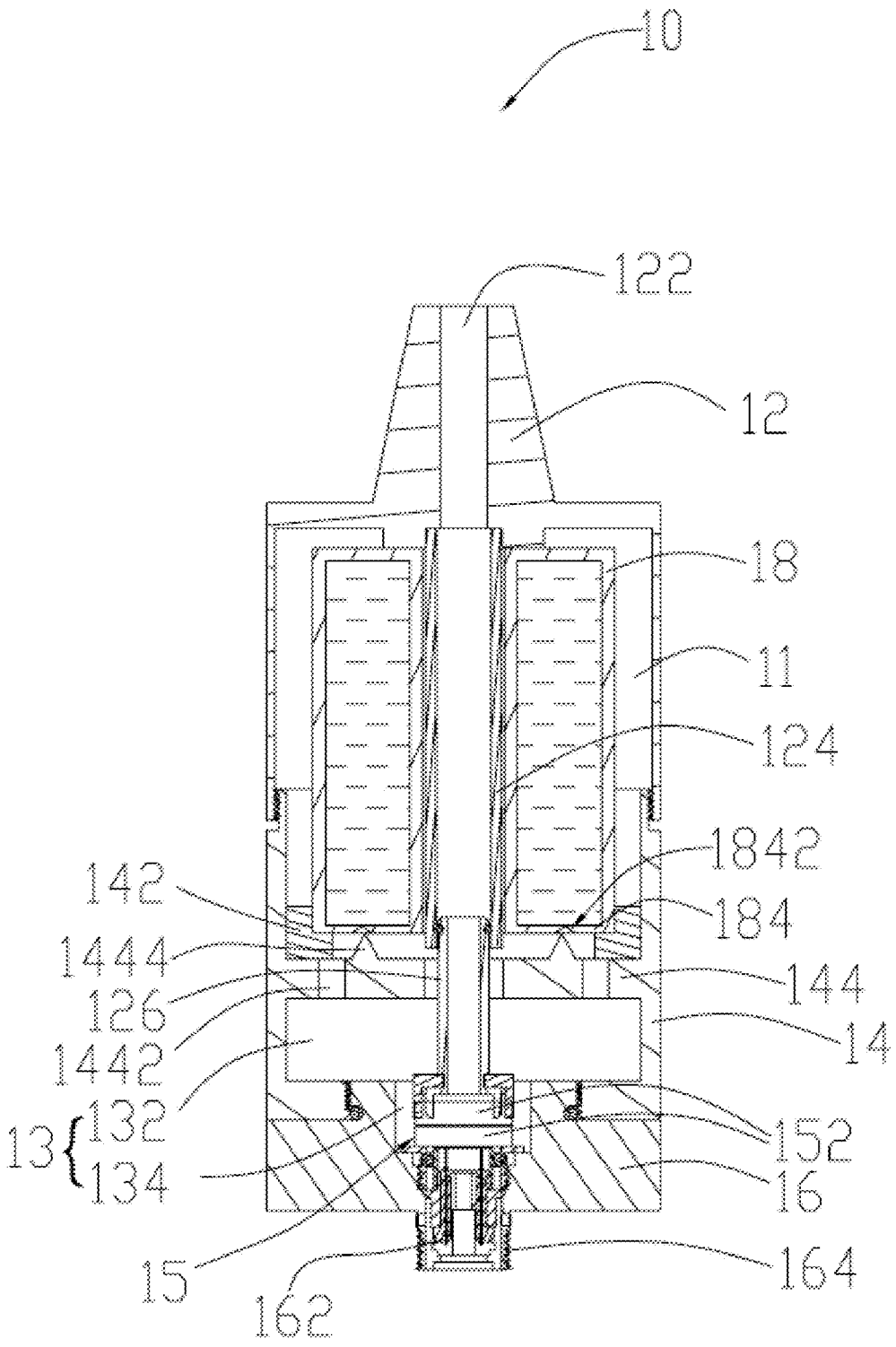
FIG. 1 is a cross-sectional view of an atomizer according to a first embodiment including a piercing element and a liquid supply, when the piercing element does not pierce the liquid supply.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
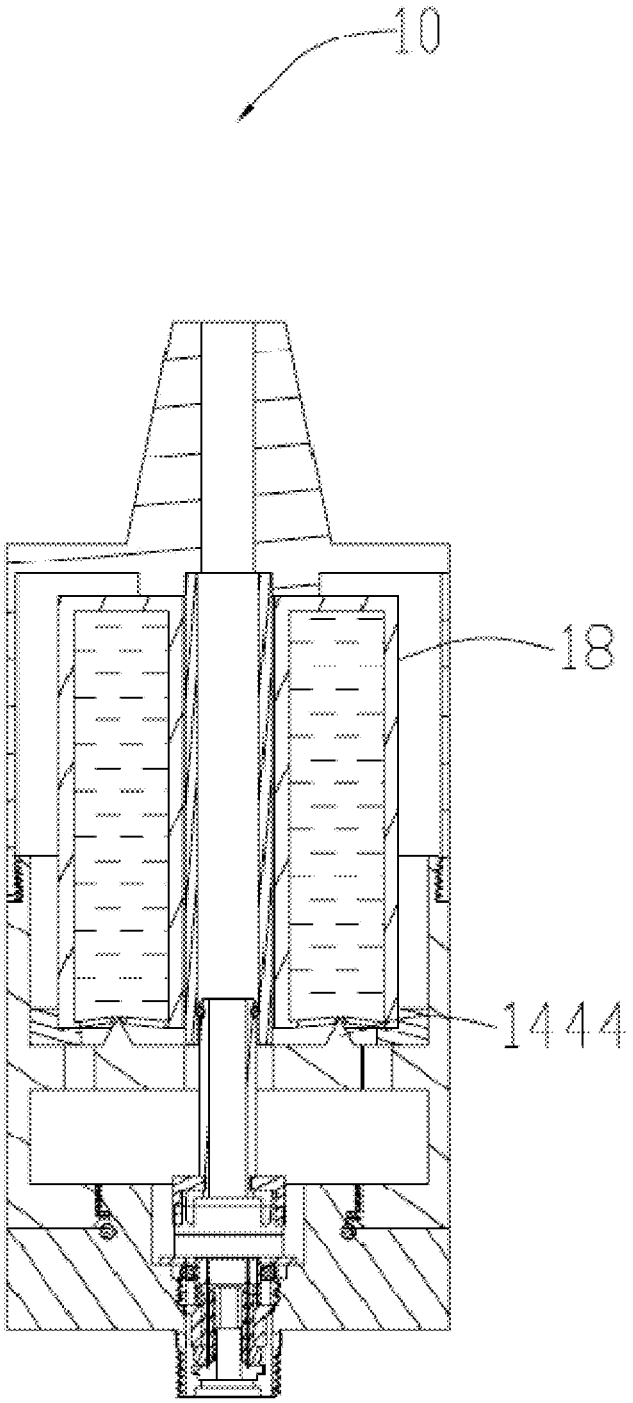
FIG. 2 is a cross-sectional view of an atomizer of FIG. 1, when the piercing element pierces the liquid supply.

Referring to FIGS. 1-2, an atomizer 10 sequentially includes a mouthpiece 12, a main body 14, and a holder 16. The mouthpiece 12 defines an air outlet 122. The main body 14 is engaged with the mouthpiece 12 and the holder 16 via screw threads. The mouthpiece 12 and the main body 14 cooperatively define a receiving space 11 for receiving a liquid supply 18. The main body 14 and the holder 16 together define a liquid chamber 13. The liquid chamber 13 includes a liquid storage area 132 and a liquid absorbing area 134. The liquid absorbing area 134 communicates with the liquid storage area 132, and is narrower than the liquid chamber 13. The mouthpiece 12 is provided with a first air pipe 124 in communication with the air outlet 122. The main body 14 is provided with a second air pipe 126 hermetically connected with the first air pipe 124.

Figure 3:
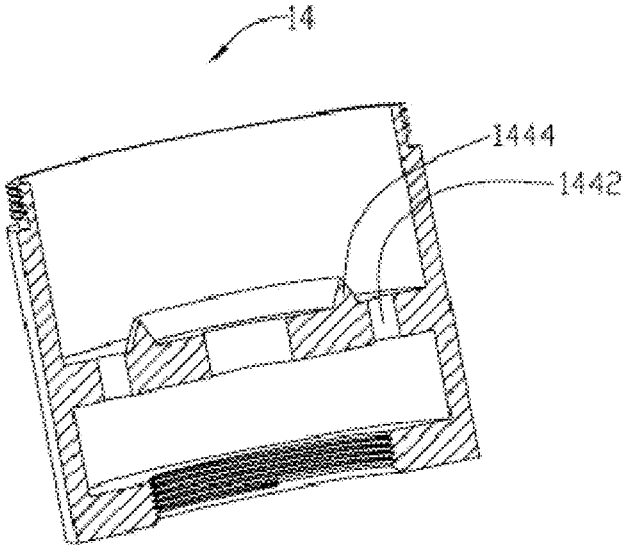
FIG. 3 is a partially cut-away view of the main body of FIG. 1.

Referring to FIG. 3, the main body 14 includes a partition plate 144 separating the receiving space 11 and the liquid chamber 13. The receiving space 11 and the liquid chamber 13 are in communication via the through hole 1442. The partition plate 144 includes a piercing element 1444 formed on a surface adjacent to the mouthpiece 12. Quite usefully, the piercing element 1444 is a continuous protrusion along a circle. The protrusion is triangular in cross-section. It is to be understood that the protrusion may also be discontinuous.

The atomizer 10 further includes an atomizing assembly 15 in the liquid absorbing area 134. The atomizing assembly 15 includes two liquid absorbing bodies 152 and a heating wire (not labeled) wound around one of the two liquid absorbing bodies 152. The two liquid absorbing bodies 152 are arranged in parallel, and are in contact with each other. The liquid absorbing bodies 152 may be made of porous material, for example, glass fiber. An end of the second air pipe 126 tightly abuts against one of the liquid absorbing bodies 152. Two ends of at least one of the liquid absorbing bodies 152 are both in contact with tobacco liquid in the liquid absorbing area 134, so that the at least one of the liquid absorbing bodies 152 absorbs the tobacco liquid. Two opposite ends of the heating wire are respectively connected to an inner electrode 162 and an outer electrode 164. The inner electrode 162 and the outer electrode 164 are connected with two electrodes of an external power supply, respectively. In the present embodiment, the atomizing assembly 15 includes two liquid absorbing bodies 152. It is to be noted that in other embodiments, the atomizer 10 may include only one liquid absorbing body 152. Accordingly, the atomizer 10 generates more aerosol than that including only one liquid absorbing body 152.

Figure 4:
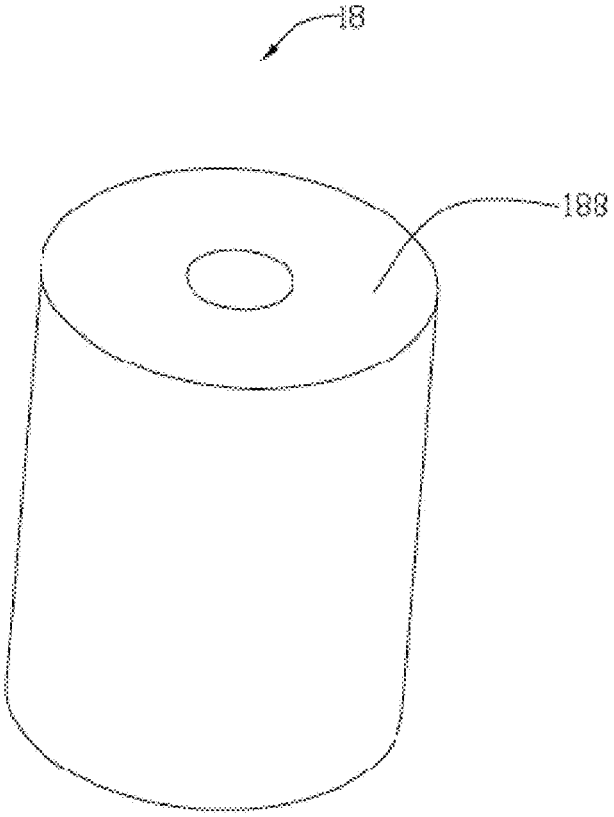
FIG. 4 is a perspective view of the liquid supply of FIG. 1.
Figure 5:
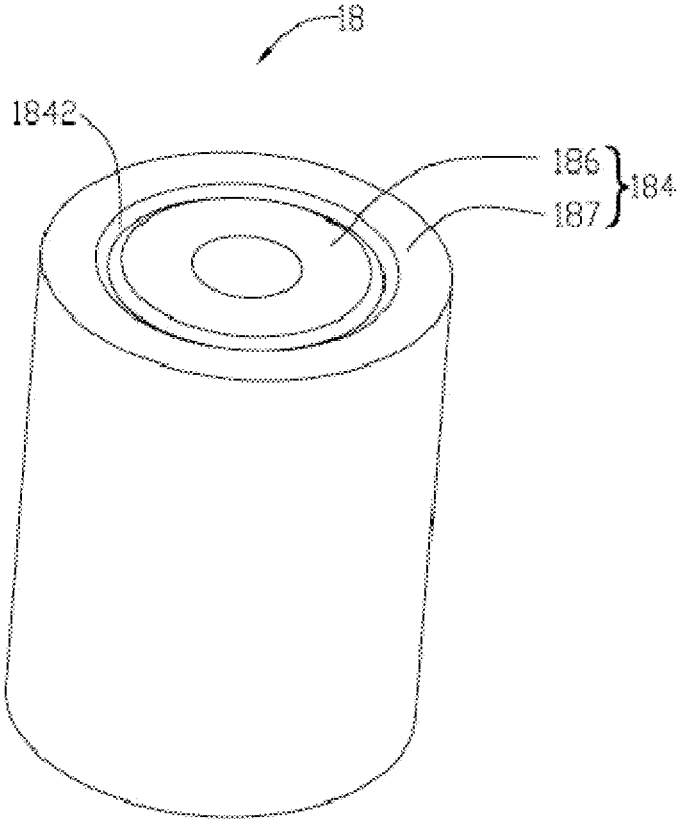
FIG. 5 is another perspective view of the liquid supply of FIG. 4.

Referring to FIGS. 4-5, the liquid supply 18 is annular in cross-section. The liquid supply 18 is substantially a cylinder defining a cylindrical through hole in a central part thereof. The through hole allows the first air pipe 124 to pass through. The liquid supply 18 includes tobacco liquid sealed therein. The liquid supply 18 includes a bottom wall 184 (one of two opposite end walls). The bottom wall 184 includes a fixing part 187, a sealing part 186, and a recessed part 1842 connecting the fixing part 187 and the sealing part 186. The recessed part 1842 is arranged along a circle, and surrounds the sealing part 186. The recessed part 1842 is triangular in cross-section. It is to be noted that the recessed part 1842 may be arc-shaped or rectangular in cross-section in other embodiments. The recessed part 1842 is spatially corresponding to the piercing element 1444, so that the piercing element 1444 pricks the recessed part 1842, and then the tobacco liquid in the liquid supply 18 flows out. The liquid supply 18 may be made of plastic or metal. Quite usefully, the bottom wall 144 is made of metal, e.g., aluminum. In the present embodiment, the liquid supply 18 is made of aluminum.

Further, an elastic gasket 142 is sandwiched between the liquid supply 18 and the partition plate 144. The elastic gasket 142 is configured (i.e., structured and arranged) for supporting the liquid supply 18, and preventing the piercing element 1444 from pricking the liquid supply 18 before use.

When the atomizer 10 is not used, the piercing element 1444 does not pierce the liquid supply 18. In use, the mouthpiece 12 is rotated relative to the main body 14, the mouthpiece 12 drives the liquid supply 18 to move towards the piercing element 1444, and the elastic gasket 142 is pressed. The mouthpiece 12 is further rotated relative to the main body 14 until an end of the screw threads. In this position, the elastic gasket 142 is further squeezed, the piercing element 1444 pricks the liquid supply 18 via the recessed part 1842, and then the tobacco liquid flows into the liquid chamber 13 via the through hole 1442. The two liquid absorbing bodies 152 absorb the tobacco liquid from the liquid chamber 13 for vaporization. When the atomizer 10 is coupled to the power supply, the power supply feeds the atomizer 10 power. After the tobacco liquid in the liquid supply 18 is used up, the mouthpiece 12 is screwed off from the main body 14, and a new liquid supply 18 is replaced.

It is to be understood that, in other embodiments, the sealing part 186 and the recessed part 1842 may be arranged on a top wall 188 of the liquid supply 18. Correspondingly, the piercing element 1444 is located above the liquid supply 18.

It is to be understood that, in other embodiments, the recessed part 1842 may be arranged in other shapes, e.g., in an ellipse.

It is to be understood that, the holder 16 of the atomizer 10 may define an air inlet (not shown) in communication with the second air pipe 126.

Figure 6:
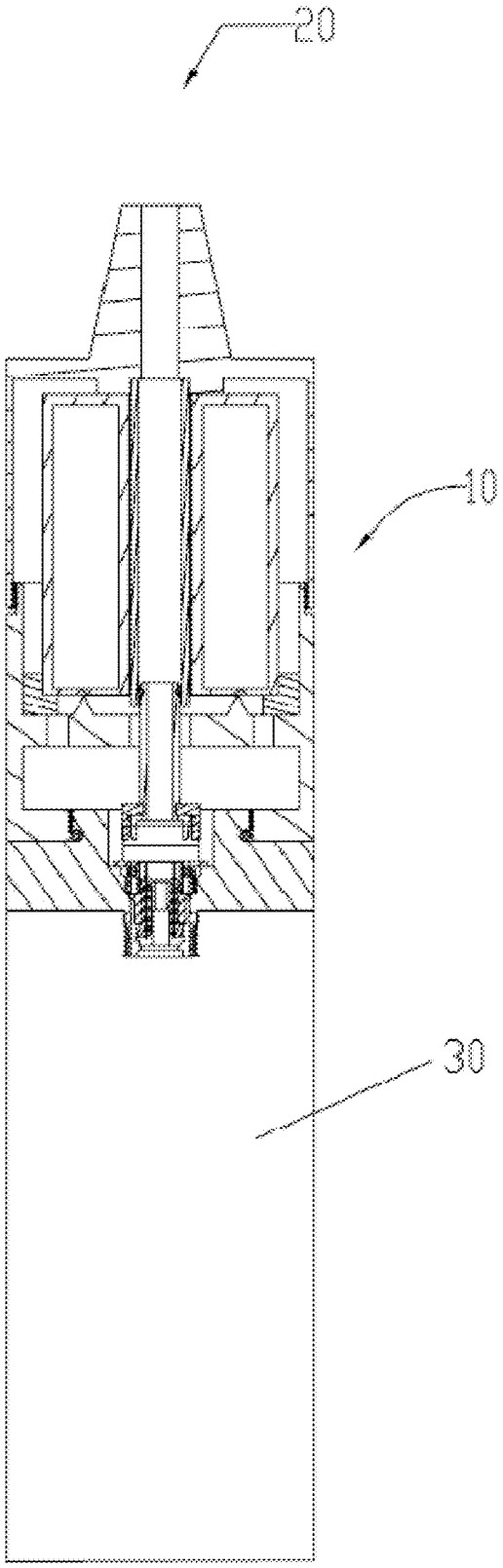
FIG. 6 is a cross-sectional view of an electronic cigarette according to a second embodiment.

Referring to FIG. 6, an electronic cigarette 20 includes an atomizer 10 and a power supply 30 detachably connected with the atomizer 10. The power supply 30 provides the atomizer power. In the present embodiment, the atomizer 10 and the power supply 30 are coupled by screw threads.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer for an electronic cigarette, comprising:

a main body;

a liquid supply configured for storing tobacco liquid, the liquid supply being received in the main body;

a piercing element; and an atomizing assembly;

wherein the liquid supply comprises an end wall including a fixing part, a sealing part, and a recessed part, the recessed part connects the fixing part and the sealing part; the piercing element is spatially corresponding to the recessed part, the piercing element is configured for pricking the recessed part and damaging the recessed part in response to an external force, so that the tobacco liquid in the liquid supply flows out through the damaged recessed part, and the atomizing assembly absorbs the tobacco liquid flowing out of the liquid supply for vaporization;

wherein the main body defines a receiving space and a liquid chamber, the liquid supply is received in the receiving space, the main body comprises a partition plate for separating the receiving space and the liquid chamber, and the piercing element is formed on a surface of the partition plate facing the liquid supply; the partition plate defines a through hole allowing the tobacco liquid in the liquid supply to flow into the liquid chamber; the atomizing assembly absorbs the tobacco liquid in the liquid chamber for vaporization.

2. The atomizer according to claim 1, further comprising an elastic gasket sandwiched between the liquid supply and the partition plate, wherein the elastic gasket is configured for supporting the liquid supply.

3. The atomizer according to claim 1, wherein the liquid chamber comprises a liquid storage area adjacent to the partition plate, and a liquid absorbing area in communication with the liquid storage area, the liquid absorbing area is narrower than the liquid storage area, and the atomizing assembly is in fluid communication with the liquid absorbing area.

4. The atomizer according to claim 1, further comprising a mouthpiece detachably connected with the main body, wherein the receiving space is cooperatively defined by the main body and the mouthpiece.

5. The atomizer according to claim 4, further comprising an air pipe, wherein the liquid supply is annular in cross-section, and the air pipe extends through the liquid supply to connect with the mouthpiece.

6. The atomizer according to claim 1, wherein the recessed part is arranged along a circle on a surface of the end wall, and the piercing element is an annular protrusion corresponding to the recessed part.

7. An electronic cigarette comprising:

an atomizer according to claim 1; and a power supply for providing power to the atomizer.

* * * * *